United States Patent [19]

McClure et al.

[11] Patent Number: 4,650,009

[45] Date of Patent: Mar. 17, 1987

[54] APPARATUS AND METHOD FOR USE IN SUBSURFACE OIL AND GAS WELL PERFORATING DEVICE

[75] Inventors: Gerald B. McClure, Sugarland; George R. Bartges, Hempstead, both of Tex.

[73] Assignee: Dresser Industries, Inc., Dallas, Tex.

[21] Appl. No.: 763,000

[22] Filed: Aug. 6, 1985

[51] Int. Cl.[4] ..... E21B 43/116

[52] U.S. Cl. ..... 175/4.6; 175/4.56; 166/55

[58] Field of Search ..... 175/4.6, 4.5, 4.51, 175/4.54, 4.55, 4.56; 166/55, 63

[56] References Cited

U.S. PATENT DOCUMENTS

| | | | |
|---|---|---|---|
| 2,326,406 | 8/1943 | Spencer | 175/4.56 |
| 2,543,814 | 3/1951 | Thompson et al. | 175/4.6 |
| 2,649,046 | 8/1953 | Davis | 175/4.6 |
| 2,761,384 | 9/1956 | Sweetman | 175/4.51 |
| 3,080,005 | 3/1963 | Porter | 175/4.6 |
| 3,659,658 | 5/1972 | Brieger | 175/4.6 |

*Primary Examiner*—Stephen J. Novosad

*Assistant Examiner*—Thuy M. Bui

*Attorney, Agent, or Firm*—Patrick H. McCollum

[57] ABSTRACT

A detonation shock wave perforating system for use in perforating subsurface earth formations traversed by a borehole. The system includes a plurality of mechanically serially connected perforating gun sections, each section of which may contain a plurality of shaped charges mounted therein and a length of detonator cord. To provide coupling of the detonation shock wave between housing sections, a booster is coupled to the detonator cord and mounted proximate a shaped charge having its axis of perforation aligned along the longitudinal axis of the gun. Detonation of the shaped charge results in a jet which detonates a quantity of explosive material in the subsequent gun section the detonation of which transfers a detonation shock wave into a detonator cord, thereby detonating any explosive connected thereto. An alternate embodiment provides for coupling of the detonator wave without using a shaped charge unit. Further, the propagation system allows any excess length of detonator cord present within the perforating gun sections to be removed.

9 Claims, 12 Drawing Figures

APPARATUS AND METHOD FOR USE IN SUBSURFACE OIL AND GAS WELL PERFORATING DEVICE

BACKGROUND OF THE INVENTION

This invention relates generally to subsurface well apparatus for propagating explosive shock waves for detonation of explosive charges within a wellbore penetrating subterranean formations.

It has become common practice in the completion of oil and gas wells to perforate the well casing and the surrounding formations to bring a well into production. One typical perforating device comprises detonating explosives of high energy and of the general character and form known as "shaped charges". In a typical embodiment, a plurality of shaped charges are mounted in a fluid-tight, cylindrical housing or on an elongated bar member which is adapted to traverse a well to be perforated. The shaped charges may be mounted in a variety of patterns along a length of the carrier member, with the axis of perforation directed generally laterally therefrom. A plurality of carrier members may be mechanically serially linked together to provide for perforating the casing and surrounding formations over a desired vertical interval.

When performing a perforating operation over a vertical length of a well, a plurality of perforating gun assemblies may be mechanically and explosively coupled in end-to-end fashion to provide detonation and thus perforating capability over the desired gun length. One method common in the prior art for explosively linking together a plurality of perforating guns is by splicing together lengths of detonator cord. This method may include the use of a side-by-side or butt contact splices of a detonating cord proximate the mechanical gun joints. These methods typically require that the detonator cord be spliced together through a port provided in the side of the gun body or mechanical coupler member. Another method common in the prior art includes using sensitive, primary explosives installed on the detonator cord proximate the mechanical gun joints. These primary explosives serve to propagate the detonating wave from one gun member to the next. The detonator cord splicing method makes gun assembly more difficult thereby substantially increasing the time required, while the use of exposed primary initiating explosives proximate the mechanical gun joints presents a substantial safety hazard from premature detonations during gun assembly.

Yet another method includes the use of an explosive wave propagation assembly having no primary explosives and typically employing a shaped charge to propagate a detonating wave from gun assembly-to-gun assembly. This propagation assembly is connected to the detonator cord inserted into the end of each gun assembly prior to assembly as a complete unit. This typically results in excessive "slack" in the detonator cord within a gun assembly which can result in improper propagation of the detonating wave causing a misfire of the shaped charge perforating devices mounted therein.

These and other disadvantages are overcome with the present invention by providing a method and apparatus for perforating well casing and the surrounding formations using an explosive wave propagation system having no primary explosives and requiring no splicing of a detonator cord and allowing removal of excessive slack from the detonator cord.

SUMMARY OF THE INVENTION

In a preferred embodiment of the invention, a perforating device is provided which, in its overall concept, includes a plurality of mechanically serially connected housing sections joined together to form a perforating gun. Each housing section may contain a plurality of shaped charges mounted therein and a length of detonator cord. To provide coupling of the detonation wave between housing sections, the detonator cord is proximate a booster mounted proximate the rear of a shaped charge having its axis of perforation aligned substantially along the longitudinal axis of the perforating gun. A detonating wave traveling along the length of detonator cord will ignite the booster thereby propogating an ignition shock into the shaped charge further resulting in a "jet" being formed. The shaped charge jet traverses the junction between housing sections striking and detonating a pellet of explosive material having a section of detonator cord proximate thereto. The ignition of the explosive pellet couples a detonation wave into a section of detonator cord traversing the housing section which fires the shaped charges, if any, contained in the housing section. In an alternate embodiment no shaped charge unit is utilized to couple the detonation wave. This spliceless method of propagating the detonation wave from section-to-section is repeated throughout the length of the perforating gun. Further, the present propagation system allows for the removal of slack, excess length, of detonator cord within the gun assemblies which can cause a misfire.

These and other features and advantages of the present invention will be more readily understood by those skilled in the art from a reading of the following detailed description with reference to the accompanying drawing.

DETAILED DESCRIPTION OF A PREFERRED EMBODIMENT

Figure 1:
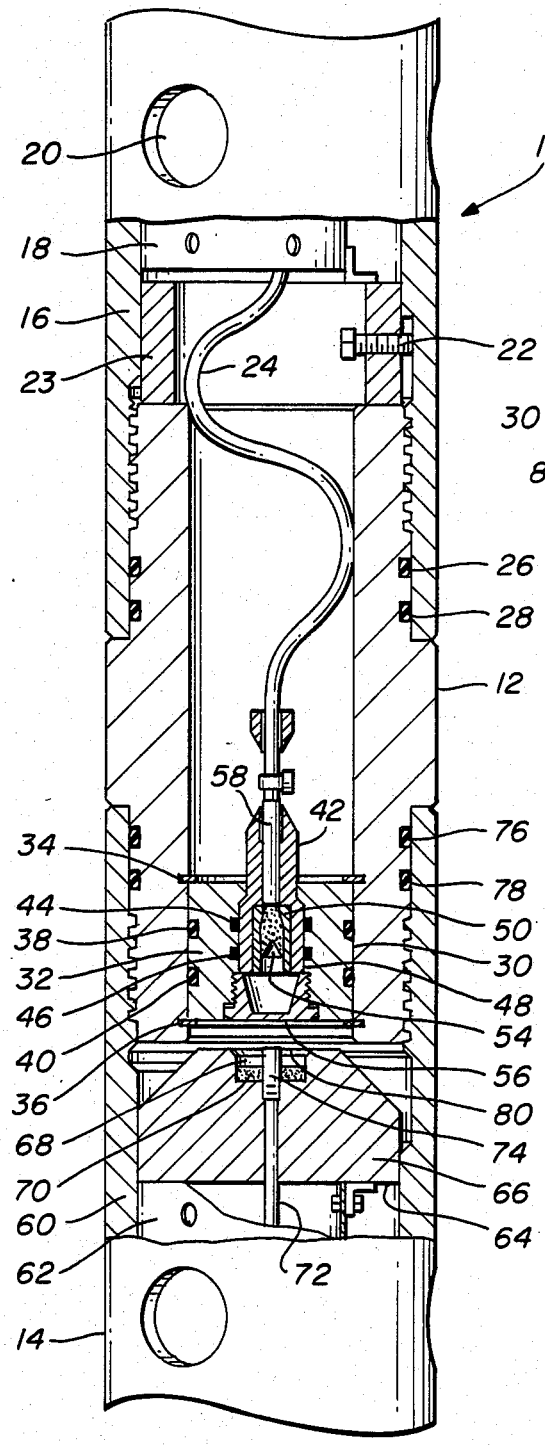
FIG. 1 PRIOR ART
FIG. 1 is a longitudinal view, partly in cross-section, of a perforating apparatus having the detonation wave coupling system often used in subsurface perforating apparatus.

Referring now to FIG. 1 in detail therein is illustrated a sectional view of a portion of perforating apparatus illustrating a donor assembly often used in such perforating apparatus. The perforating apparatus as illustrated includes a first perforating gun member 10, a connector sub 12 and second perforating gun member 14. Perforating gun member 10 includes an elongated, tubular gun body member 16. Housed within body member 16 is length of carrier strip 18 having a plurality of shaped charges (not illustrated) mounted in spaced relation along the length thereof. The shaped charges are aligned on carrier strip 18 with their axis of perforation generally laterally directed therefrom and preferably directed through sealed ports, illustrated by port 20, provided in body member 16. Carrier strip 18 is rotatably and slideably secured within body member 16 by screw 22 and tubular spacer 23. A length of detonator cord 24 runs the length of gun body 16 for providing detonation of the shaped charges in a manner familiar in the art. Detonator cord 24 is preferably, but not limited to, the type known commercially as R.D.X. plastic covered Primacord.

Gun body member 16 is mechanically coupled by suitable means, such as a threaded joint, to connector sub 12. The threaded joint is provided with an occlusive fluid seal by O-rings 26 and 28. Mounted within connector sub 12 is donor assembly 30 of the detonation system. Donor assembly 30 includes an outer housing or bushing 32 sized for insertion within the internal bore of connector sub 12 and having a central bore therethrough. A pair of retainer rigs 34 and 36 constrain donor assembly 30 within connector sub 12 and a pair of O-rings 38 and 40 provide an occlusive fluid seal therebetween. Retained within the central bore of bushing 32 and extending rearwardly therefrom is an internal member 42 having a pair of O-rings 44 and 46 thereabout. Mounted within an internal cavity of internal member 42 is shaped charge 48. Shaped charge 48 may be various designs known in the art, in the preferred embodiment shaped charge 48 is approximately one inch in length and one-half inch in diameter with charge case 50 having approximately one gram of explosive material 52 surmounted therein by a conically shaped metal liner or cone 54. The explosive material 52 preferably should be a high explosive material such as that commonly known as cyclonite. Screw port 56 is threadably installed within outer housing 32 substantially in line with the axis of perforation of the "jet" produced by shaped charge 48. Retained within the rearward portion of internal housing 42 is booster 58. Booster 58 is preferably a model P-3 booster commercially available from DuPont Corporation. Booster 58 is retained within member 42 having the output end proximate the rear section shaped charge 48 and the other end attached to detonator cord 24 by suitable means such as a crimped connection.

Connector sub 12 is threadably coupled to gun member 14. The threaded joint is provided with a fluid tight seal by O-rings 76 and 78. Gun member 14 is substantially identical with gun member 10 and includes an elongated, tubular gun body member 60 having a carrier strip 62 retained therein. Mounted along the length of carrier strip 62 are a plurality of shaped charges (not illustrated). Mounted within the central bore of gun body member 60 is acceptor assembly 64 of the propagation system. Acceptor assembly 64 includes a housing or holder member 66 having a cavity 68 formed generally centrally therein. In the particular embodiment illustrated, mounted within the cavity is a pellet of explosive material 70. Explosive pellet 70 can be from approximately 2 to 6 grams of cyclonite or other suitable explosive material. Cavity 68 is covered with a suitable sealing member 80 such as a relatively thin piece of aluminum. Explosive pellet 70 may have a ring configuration. Protruding through the center of explosive pellet 70 and extending into cavity 68 is one end of detonator cord 72 having sealing cap 74 crimped thereon. Detonator cord 72 extends the length of the gun body 14 and provides detonation of any shaped charges mounted therein. The second end of detonator cord 72 may be terminated at a donor assembly identical to donor assembly 30 thereby allowing for the serial explosive coupling of additional gun assemblies onto gun member 14.

Described is a system for assembling a series of perforating guns wherein no primary explosives are used in the gun assembly and no splicing of the detonator cord is necessary. In making up a perforating gun assembly for perforating well casing and/or surrounding formations it is preferably to have the perforating gun assembly be approximately the length of the vertical interval to be perforated. This eliminates multiple runs into a well. In assembly of the perforating apparatus, body member 16 is threadably connected to connector sub 12 with detonator cord 24 and installed within the central bore of member 42 thereby placing booster 58 in proximity with the rear of shaped charge 48. Donor assembly 30 is inserted into the central bore of connector sub 12 and retainer ring 36 is inserted. Gun body member 14 is threadably connected to connector sub 12. This assembly procedure continues until a gun assembly of the desired length is obtained. The assembled perforating gun is lowered into position within a well opposite the zone to be perforated. The shaped charges can be fired by a percussion firing assembly which can be placed atop the perforating gun assembly and triggered by dropping a sinker bar, commonly referred to as a "go devil".

In the operation of the propagation system, a detonating wave travels through detonator cord 24 terminated at booster 58. Booster 58 augments the explosive component of detonator cord 24 causing detonation of shaped charge 48. A detonation wave thus caused travels forwardly striking the apex of liner 54. The wavefront continues traveling forwardly through the explosive material simultaneously collapsing liner 54 inwardly about the axis of liner 54 causing the inner surface extrude to form part of a jet stream. The jet so formed penetrates screw port 56 and seal 80 striking explosive material 70. The explosion of explosive material 70 is transferred to detonator cord 72 thereby detonating the shaped charges of perforating gun member 14. It should be recognized that detonator cord 72 may connect to a donor assembly at the lower end of gun member 14 so that the detonation wave may be likewise propagated to the next inline gun member.

Due to the assembly requirements, whereby booster 58 is connected to detonator cord 24 and installed within the central bore of member 42 prior to insertion of donor assembly 30 within the central bore of connector sub 12, some added length of detonator cord 24 is required. When donor assembly 30 is inserted within connector sub 12 this added length of detonator cord 24 results in slack in detonator cord 24 which may loop or twist upon itself. This can result in a propagation failure causing misfiring during gun firing procedure. In order to reduce the chances of propagation failure resulting from the excessive length of detonator cord the present invention addresses a method and apparatus for eliminating the excessive length while propagating a detonating wave between perforating gun assemblies.

Figure 2A:
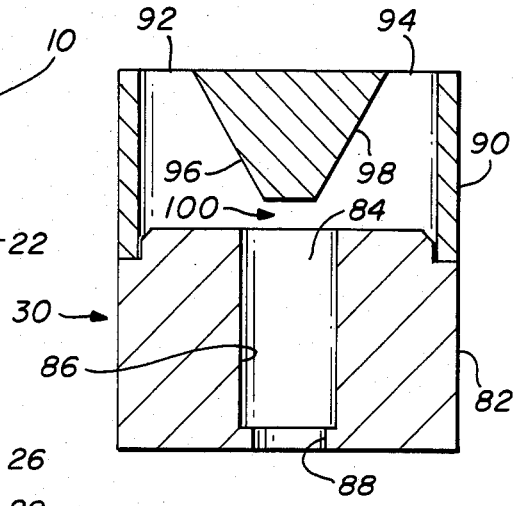
FIG. 2A is a cross-sectional view of one embodiment of the donor assembly 30 of FIG. 1.

Referring now to FIG. 2A there is illustrated a cross-sectional view of one embodiment of donor assembly 30 which can serve to couple a detonating wave to acceptor assembly 64 while providing for the elimination of any excessive length of detonator cord 24. Donor assembly 30 includes a first section 82 having a central bore 84 therethrough for retaining shaped charge 48. Central bore 84 comprises a first bore section 86 having a inner diameter approximate the outer diameter of shaped charge 48 and a second bore section 88 having a reduced inner diameter from that of first bore section 82. Shaped charge 48 is inserted within first bore section 86 with the axis of perforation of the jet directed toward second bore section 88 and this toward acceptor assembly 64, illustrated in FIG. 1.

Figure 2B:
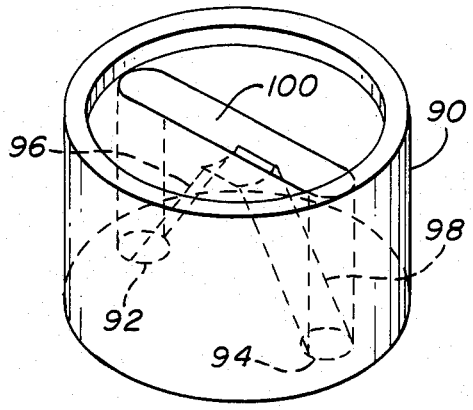
FIG. 2B is an isometric view of the assembly of FIG. 2A.

Donor assembly 30 further includes a second section 90 which functions to allow removal of any excessive length of detonator cord 24 which may be in the gun assembly. Second section 90 of donor assembly 30 is illustrated in isometric view in FIG. 2B. Common reference numbers are used in both FIGS. 2A and 2B. Second section 90 includes first and second bores, 92 and 94, each having a wall, 96 and 98, generally tapered toward the center line of second section 90. Bores 92 and 94 are connected by lateral groove 100.

Figure 6:
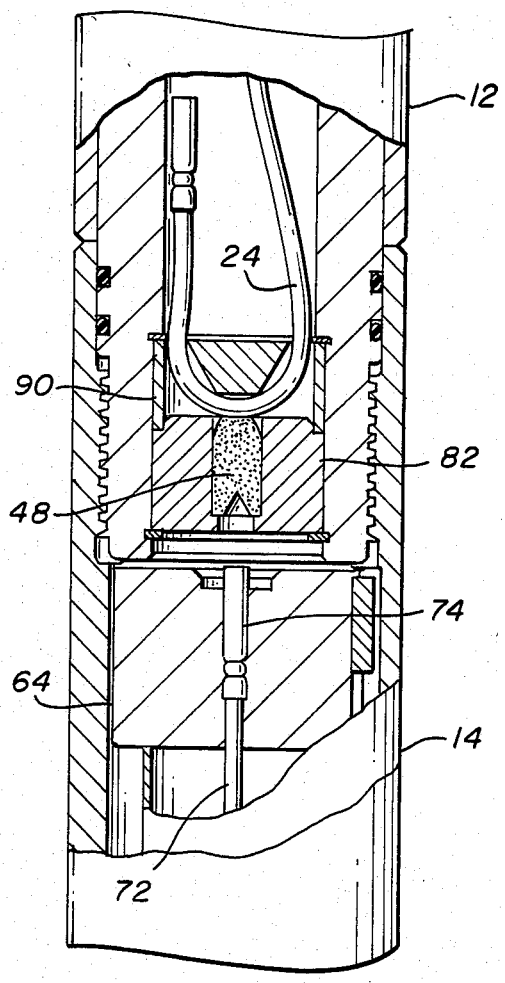
FIG. 6 is a longitudinal view, partly in cross-section, of a perforating apparatus having the detonation wave coupling system utilizing the donor assembly illustrated in FIG. 2.

FIG. 6 illustrated in the operation of the propagation system using the donor assembly of FIG. 2. Second section 90 of donor assembly 30 is inserted into position within connector sub 12 with detonator cord 24 extending through either bore, 92 or 94. Any excess length of detonator cord 24 which may be present within the gun assembly is removed by tension and the end of detonator cord 24 is formed into a substantially U-shaped configuration within bore 92, lateral groove 100 and bore 94 with any excessive length, slack, removed from detonator cord 24. Shaped charge 48 is inserted within first bore section 86 of first section 82 and first section 82 is inserted into position within connector sub 12. The donor assembly is retained within connector sub by retainer rings as illustrated in FIG. 1. The detonation wave will be transferred from detonator cord 24 to shaped charge 48 resulting in a jet a previously described.

Referring now to 3A, 3B and 3C there is illustrated another embodiment of a donor assembly 30 which can couple a detonation wave by means of a shaped charge mounted therein while providing for the elimination of any excessive length of detonator cord 24. Donor assembly 30 consists of a generally cylindrical member 102 having a central bore 104 comprises a first bore section 106 having an inner diameter approximate the outer diameter of shaped charge 48 and a second bore section 108 having a reduced inner diameter from that of first bore section 104. It should be recognized that central bore 104 can be sized for insertion of shaped charge 48 from either end of the bore. Located on the periphery of circular member 102 are first and second longitudinal grooves, 110 and 112. Grooves 110 and 112 are displaced on the periphery ninety degrees relative to one another with groove 119 traversing the entire length of member 102 and groove 112 being truncated. Grooves 110 and 112 are interconnected at one end thereof by diagonal groove 114 located in one face of member 102. Lateral bore 116 partially traverses member 102 intercepting groove 110 and center bore 104.

Figure 3A:
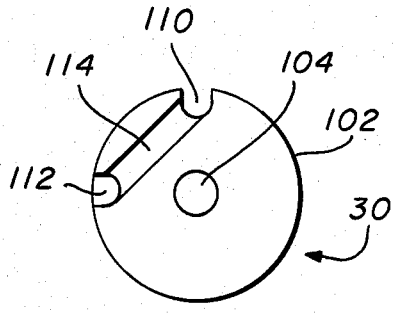
FIG. 3A–3C represent top, side and cross-sectional views, respectively, of another embodiment of the donor assembly 30 of FIG. 1.
Figure 3B:
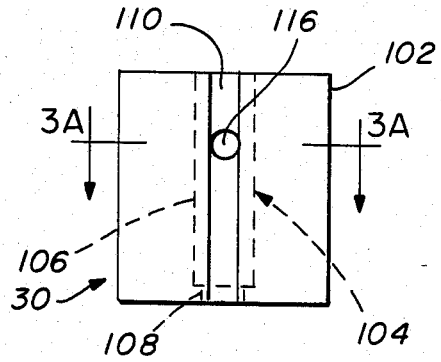
Figure 3C:
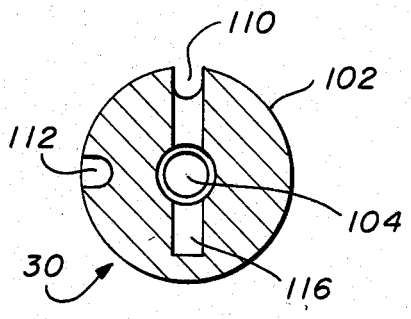

In the operation of the propagation system using the donor assembly of FIG. 3 shaped charge 48 is inserted within central bore 104. Booster 58 is inserted into lateral bore 116 and donor assembly member 102 is inserted into position within connector sub 12 with detonator cord 24 extending through groove 110. Any excess length of detonator cord 24 present within the gun assembly is removed by tension and the end of detonator cord 24 is placed into diagonal groove 114 and groove 112. Any detonation wave will be transferred from detonator cord 24 to booster 58 thereby detonating shaped charge 48.

Figure 4A:
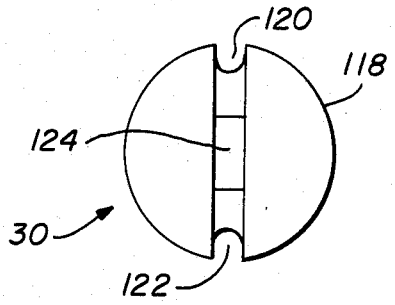
FIGS. 4A and 4B are top and cross-sectional views of another embodiment of the donor assembly 30 of FIG. 1.
Figure 4B:
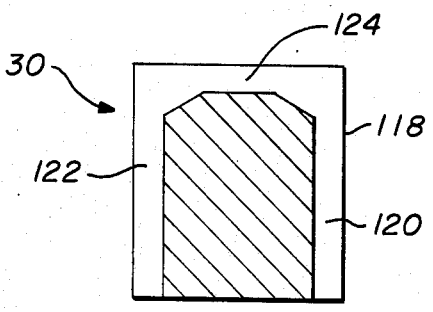

Other embodiments of the present invention are illustrated in FIGS. 4 and 5. The donor assembly 30, illustrated in FIGS. 4 and 5, serve to couple a detonation wave, without a shaped charge unit, while providing for the elimination of excessive length of detonator cord 24. Referring not to FIGS. 4A and 4B there is illustrated a first embodiment of this donor assembly 30. Donor assembly 30 includes a generally cylindrical member 118 having first and second longitudinal grooves, 120 and 122 traversing the entire length of the periphery of member 118. Grooves 120 and 122 are displaced on the periphery one-hundred and eight degrees from one another and connected at least at one end thereof by a lateral groove, 124. It should be recognized that a second lateral groove may connect the second end of grooves 120 and 122 thereby allowing donor assembly to be inserted in either direction into connector sub 12.

Figure 5A:
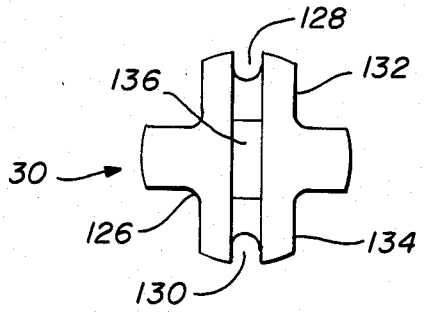
FIGS. 5A and 5B are top and cross-sectional views of yet another embodiment of the donor assembly 30 of FIG. 1
Figure 5B:
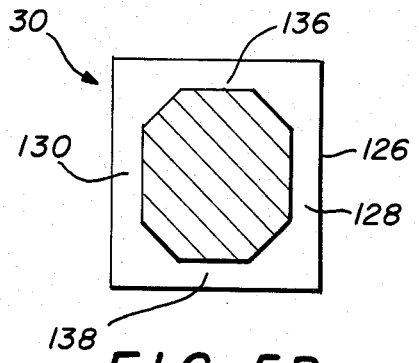

Referring now to FIGS. 5A and 5B there is illustrated a second embodiment of the donor assembly 30 utilizing no shaped charge unit. Donor assembly 30 comprises a generally cross-shaped member 126 having first and second longitudinal grooves, 128 and 130, formed in opposite crowned spline portions 132 and 134. In the embodiment illustrated longitudinal grooves 128 and 130 are connected to one another at each end thereof by lateral grooves 136 and 138; however, it should be recognized that the second lateral groove may be eliminated without affecting the operation.

Figure 7:
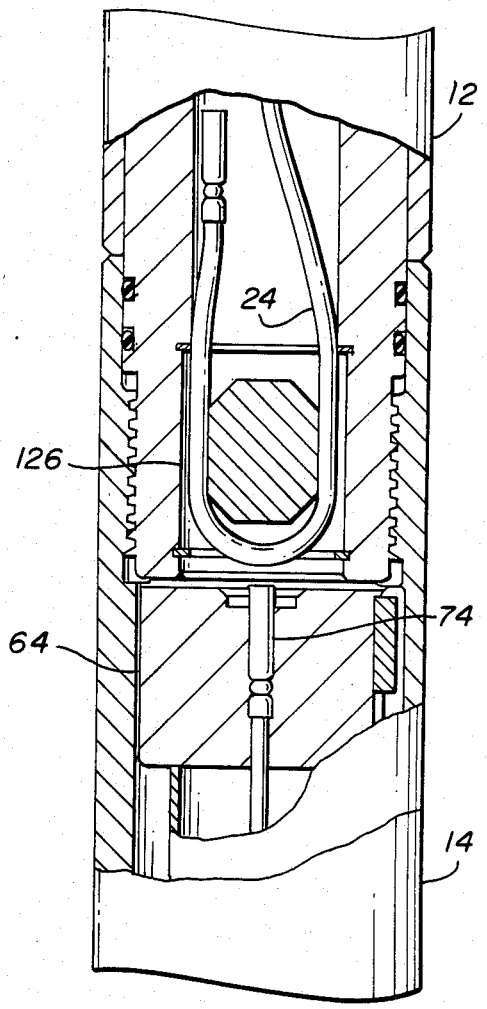
FIG. 7 is a longitudinal view, partially in cross-section, of a perforating apparatus having the detonation wave coupling system utilizing the donor assembly illustrated in FIG. 5.

The operation of the propagation system using the donor assemblies illustrated in FIGS. 4 and 5 is illustrated in FIG. 7. Donor assembly 30 is inserted into connector sub 12 having detonator cord 24 extending through one of the longitudinal grooves, for example groove 120 of FIG. 4 or 128 of FIG. 5. Any excess length of donor cord 24 is removed from within the gun assembly and a termination cap 140 is crimped to the end of detonator cord 24 which is inserted into the opposite longitudinal groove, in this example 122 or 130. Any detonation wave in detonator cord 24 will be transferred directly into acceptor assembly 64 as previously described herein.

Many modifications and variations besides those specifically mentioned may be made in the techniques and structures described herein and depicted in the accompanying drawing without departing substantially from the concept of the present invention. For example, while the specification describes the use of a percussion firing system it should be recognized that the present invention may be used in conjuncton with perforating gun carried on and/or detonated by means of a wireline or any other suitable means. Accordingly, it should be clearly understood that the form of the invention described and illustrated herein is exemplary only, and is not intended as a limitation on the scope of the present invention.

The embodiments of the invention in which an exclusive property or privilege is claimed are defined as follows;

1. An apparatus for perforating subsurface earth formations traversed by a borehole including a plurality of mechanically serially connected perforating guns, comprising:

a first perforating gun member, said gun member including an elongated gun body having a plurality of shaped charges cooperatively arranged thereon and a first length of detonator cord, for transferring an explosive wave to said shaped charges, traversing therethrough;

a second perforating gun member mechanically serially connected to said first perforating gun member, said gun member including an elongated gun body having a plurality of shaped charges cooperatively arranged thereon and a second length of detonator cord, for transferring an explosive wave to said shaped charges, traversing therethrough; and propagation means disposed within said first perforating gun member for eliminating any excess length of said first detonator cord from within said first perforating gun member and for propagating a detonating wave from said first detonator cord to said second detonator cord in said second perforating gun member.

2. An apparatus for perforating subsurface earth formations traversed by a borehole, comprising:

a first perforating gun member, said gun member including an elongated gun body having a plurality of shaped charges cooperatively arranged thereon and a first length of detonator cord traversing therethrough;

a second perforating gun member, said gun member including an elongated gun body having a plurality of shaped charges cooperatively arranged thereon and a second length of detonator cord traversing therethrough; and propagation means for eliminating any excess length of said first detonator cord from within said first perforating gun member and for propagating a detonating wave from said first detonator cord to said second detonator cord in said second perforating gun member, wherein said propagation means further comprises:

a first member having a central bore therethrough;

a shaped charge mounted within said core and having the axis of perforating aligned with the axis of said bore; and a second member demountably coupled to said first member, said second member having first and second bore therein connected by a lateral groove for containing said detonator cord.

3. The apparatus of claim 1 wherein said propagation means further comprises:

a body member having first and second longitudinal grooves located on the outer dimension thereof and connected by a groove located on at least one face of said body member;

said first detonator cord contained within said grooves.

4. The apparatus of claim 3 wherein said propagation means further comprises:

a shaped charge housed within a longitudinal bore within said body member; and and explosive booster mounted within a lateral bore proximate said shaped charge, said lateral bore intercepting said longitudinal bore and one of said longitudinal grooves.

5. An apparatus for propagating a detonating wave within a subsurface perforating apparatus and providing for the elimination of any excess length of detonator cord within at least a portion of said perforating apparatus comprising:

a first section having a generally central bore;

a shaped charge retained within said central bore having the axis of perforation aligned with the longitudinal axis of said perforating apparatus;

a second section coupled to said first section, said second section having means for containing a section of detonator cord in proximity with said shaped charge.

6. An apparatus for propagating a detonating wave within a subsurface perforating apparatus and providing for the elimination of any excess length of detonator cord within at least a portion of said perforating apparatus comprising:

a first section having a generally central bore;

a shaped charge retained within said central bore;

a second section coupled to said first section, said second section having means for containing a section of detonator cord in proximity with said shaped charge, wherein said second section further comprises a generally cylindrical member having first and second bores therethrough connected at one end thereof by a lateral groove.

7. The apparatus of claim 2 wherein said first and second bores converge.

8. The apparatus of claim 7 wherein said central bore further comprises:

a first bore section for housing said shaped charge; and a second, reduced diameter, bore section.

9. The apparatus of claim 8 wherein said propagation means is coaxially disposed within said first perforating gun member.

* * * * *